US008912864B2

(12) United States Patent
Morgenstern

(10) Patent No.: US 8,912,864 B2
(45) Date of Patent: Dec. 16, 2014

(54) HIGH-FREQUENCY SIGNAL COMBINER

(75) Inventor: Michael Morgenstern, Schoeneiche (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 298 days.

(21) Appl. No.: 13/505,282

(22) PCT Filed: Oct. 7, 2010

(86) PCT No.: PCT/EP2010/006137

§ 371 (c)(1),
(2), (4) Date: Apr. 30, 2012

(87) PCT Pub. No.: WO2011/050898

PCT Pub. Date: May 5, 2011

(65) Prior Publication Data

US 2012/0212302 A1 Aug. 23, 2012

(30) Foreign Application Priority Data

Oct. 29, 2009 (DE) ..... 10 2009 051 229

(51) Int. Cl.
*H01P 3/08* (2006.01)
*H01P 5/12* (2006.01)
*H01P 5/10* (2006.01)

(52) U.S. Cl.
CPC ... *H01P 5/10* (2013.01); *H01P 5/12* (2013.01)
USPC ..... 333/127; 333/129; 333/132; 333/134

(58) Field of Classification Search
USPC ..... 333/126–129, 132, 134
See application file for complete search history.

(56) References Cited

U.S. PATENT DOCUMENTS

| | | | | |
|---|---|---|---|---|
| 5,726,655 | A | 3/1998 | Acher et al. | |
| 6,246,299 | B1 | 6/2001 | Werlau | |
| 6,741,814 | B1 | 5/2004 | Kosoff | |
| 7,077,919 | B2 * | 7/2006 | Wood et al. | 148/122 |
| 2009/0033436 | A1 | 2/2009 | Ahlers | |

FOREIGN PATENT DOCUMENTS

| | | | |
|---|---|---|---|
| CN | 101465457 | A | 6/2009 |
| JP | 2004-103742 | A | 4/2004 |
| WO | WO 02/095775 | A1 | 11/2002 |

OTHER PUBLICATIONS

International Search Report for PCT Application No. PCT/EP2010/006137 dated Feb. 10, 2011, pp. 1-3.
English translation of International Preliminary Report on Patentability for PCT/EP2010/006137 dated Aug. 9, 2012, pp. 1-8.

* cited by examiner

*Primary Examiner* — Robert Pascal
*Assistant Examiner* — Kimberly Glenn
(74) *Attorney, Agent, or Firm* — Ditthavong & Steiner, P.C.

(57) ABSTRACT

A high-frequency signal combiner includes a first input terminal for the connection of a first high-frequency signal, a second input terminal for the connection of a second high-frequency signal, an output terminal for the output of the third high-frequency signal combined from the first and the second high-frequency signal. A first coaxial line extends between the first input terminal and the output terminal. A second coaxial line extends between the second input terminal and the output terminal. Furthermore, an annular core is provided, through the recess of which the first and second coaxial line are guided each in a different direction. The annular core is manufactured from an axially wound strip which includes a first layer made of a magnetizable material and a second layer made of an insulating material.

8 Claims, 3 Drawing Sheets

HIGH-FREQUENCY SIGNAL COMBINER

CROSS-REFERENCE TO RELATED APPLICATION

The present application is a national phase application of PCT Application No. PCT/EP2010/006137, filed on Oct. 7, 2010, and claims priority to German Patent Application No. DE 10 2009 051 229.2, filed on Oct. 29, 2009, the entire contents of which are herein incorporated by reference.

BACKGROUND OF THE INVENTION

1. Field of the Invention

The invention relates to a high-frequency signal combiner.

2. Discussion of the Background

High-frequency amplifiers based on semiconductors are limited with regard to their power amplification. This technical disadvantage is overcome by supplying the high-frequency signal to be amplified to several high-frequency amplifiers at the same time, of which the outputs are connected to a high-frequency combiner in order to combine a high-frequency signal, which corresponds to the sum of the high-frequency output signal generated by each high-frequency amplifier.

A high-frequency signal combiner of this kind comprising individual coaxial lines is disclosed in U.S. Pat. No. 6,246,299 B1.

In the event of a failure of one high-frequency amplifier, the high-frequency signal combiner is supplied in an asymmetric manner. This asymmetry in the control of the high-frequency signal combiner causes disturbing high-frequency signals on the exterior of the coaxial lines of the high-frequency signal combiner, so-called sheath waves, which are attenuated by the ferrite-core-amplified inductance of the coaxial lines.

The arrangement of the high-frequency signal combiner disadvantageously provides a large structural volume because of the spatial extension of the coaxial lines and the ferrite core.

SUMMARY OF THE INVENTION

Embodiments of the invention therefore advantageously provide a high-frequency signal combiner which provides a reduced structural volume.

Instead of the ferrite core manufactured according to the prior art using sintering technology, a core made from an axially wound strip which comprises a first layer made of a magnetizable material and a second letter made of an insulating material is used according to the invention. By comparison with the ferrite core of the prior art, this core provides significantly improved magnetic properties and a significantly improved compactness.

In order to achieve the maximum possible magnetizability of the core, the first layer comprising iron as the magnetizable material provides a significantly greater thickness, namely preferably 5 to 50 μm, by particular preference 16 to 20 μm, by comparison with the second layer comprising, for example, magnesium oxide as the insulating material, the thickness of which is preferably 0.1 to 1 μm, for example, 0.5 μm.

In order additionally to reduce the structural volume of the high-frequency signal combiner, some of the lines of the high-frequency signal combiner are embodied as striplines. These correspond to the coaxial lines of the high-frequency signal combiner according to U.S. Pat. No. 6,246,299, B1 which, in each case, lead the current flowing from one end of the coaxial line to the other on the inside of the shielding of the coaxial line back to the one end of the coaxial line.

To achieve improved electrical parameters of the high-frequency signal combiner, for example, improved S-parameters, the surge impedance of the coaxial lines, which is preferably 35 Ω, preferably provides a different value from the surge impedance of the striplines, which is preferably 15 Ω. As a result of the series connection of a coaxial line and a stripline in each case, an input impedance of 50 Ω is obtained at the input end, and an output impedance of 25 Ω is obtained at the output end. The physical length of the coaxial lines, which is preferably 187 mm, also provides a different value from the physical length of the striplines, which is preferably 92.3 mm.

BRIEF DESCRIPTION OF THE DRAWINGS

The high-frequency signal combiner according to the invention is explained in greater detail below by way of example with reference to the drawings. The drawings are as follows.

DETAILED DESCRIPTION OF EXEMPLARY EMBODIMENTS OF THE INVENTION

Figure 1A:
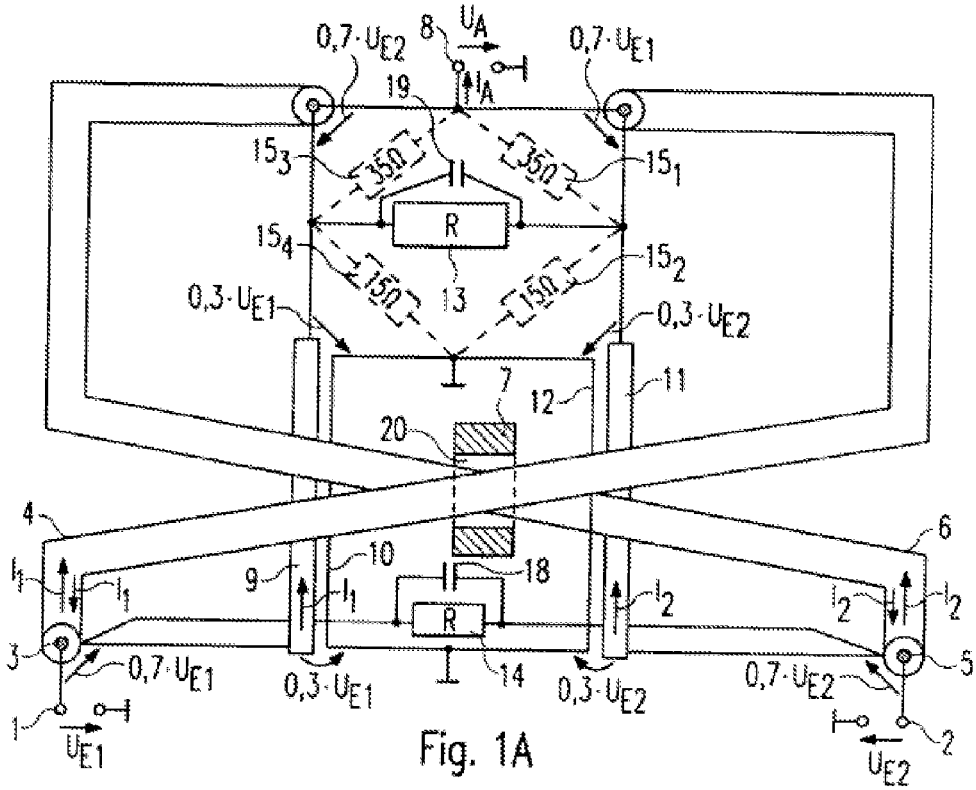
FIG. 1A shows a circuit diagram for a high-frequency signal combiner according to the invention with symmetrical control.

In the following section, the high-frequency signal combiner according to the invention is explained on the basis of FIG. 1A for full operation with symmetrical control, that is, for undisturbed operation, and on the basis of FIG. 1B for operation with asymmetric control, that is, for disturbed operation.

With symmetrical control of the high-frequency signal combiner, a first high-frequency signal with the signal level $U_{E1}$, for example, the output signal of a first high-frequency amplifier, is supplied at the first input terminal, also referred to below as the first input port 1, and a second high-frequency signal with the signal level $U_{E2}$, for example, the output signal of a second high-frequency amplifier, is supplied at the second input terminal, also referred to below as the second input port 2. For reasons of symmetry, in the ideal case, the first high-frequency signal $U_{E1}$ and the second high-frequency signal $U_{E2}$ provide the same phase and the same amplitude.

The first input port 1 is connected at the input end of a first coaxial line 4 to the inner conductor 3 of a first coaxial line 4. The second input port 2 is connected at the input end of a second coaxial line 6 to the inner conductor 5 of a second coaxial line 6. The first and second high-frequency line 4 and 6 are each guided in opposite directions through the recess or borehole 20 of the annular core 7 enclosed by the annular core 7. The inner conductor 3 of the first coaxial line 4 and the inner conductor 5 of the second coaxial line 6 are each combined at the output end of the first coaxial line 4 and the second coaxial line 6 and guided to an output terminal, also referred to below as the output port 8, at which the third high-frequency signal is present, of which the signal amplitude $U_A$ corresponds to the signal amplitude $U_{E1}$ and $U_{E2}$ of the first and second high-frequency signal, which, in the ideal case, are identical with regard to amplitude and phase. However, the currents are added at the output.

The outer conductor of the first coaxial line 4 is connected at the output end of the first coaxial line 4 to the output end of a first stripline 9 and at the input end of the first coaxial line 4 to the input end of the first stripline 9. An earth line 10 associated with the first stripline 9 is connected to the earth terminal on the printed circuit board of the high-frequency signal combiner. The outer conductor of the second coaxial line 6 is connected at the output end of the second coaxial line 6 to the output end of a second stripline 11 and at the input end of the second coaxial line 6 to the input end of the second stripline 11. An earth line 12 associated with the second stripline 11 is also connected to the earth terminal on the printed circuit board of the high-frequency signal combiner.

A load balancing resistor 13 of 50 Ω in the exemplary embodiment is arranged at the two outputs of the first and second coaxial line 4 and 6, between the outer conductor of the first and second coaxial line 4 and 6, for the compensation of a first and second high-frequency signal which is asymmetric with regard to its signal amplitude or signal power, and a capacitor 19 is arranged in parallel with this for the compensation of residual reactances within the high-frequency signal combiner. In an equivalent manner, at the two inputs of the first and second coaxial line 4 and 6, between the outer conductor of the first and second coaxial line 4 and 6, an input balancing resistor 14 of 50 Ω is provided for the compensation of a first and second high-frequency signal which is asymmetric with regard to its signal amplitude or signal power, and, in parallel with this, a capacitor 18 is provided for the compensation of residual reactances within the high-frequency signal combiner.

The surge impedance of the first and second coaxial line 4 and 6 in the exemplary embodiment is 35 Ω respectively, whereas the surge impedance of the first and second stripline 9 and 11 in the exemplary embodiment is 15 Ω respectively. Because of the electrical connection of the outer conductor of the first and/or second coaxial line 4 and 6 to the first and second stripline 9 and 11 respectively, the first coaxial line 4 and the first stripline 9, and the second coaxial line 6 and the second stripline 11 are connected to one another in series and form a voltage splitter between the voltage potential on the inner conductor of the first or second coaxial line 2 or 4 and the earth potential on the earth line 10 or 12 of the first or second stripline 9 and 11. Each of these two voltage splitters is indicated schematically in FIG. 1A and respectively 1B with a dotted line through the series connected resistors $\mathbf{15}_1$ and $\mathbf{15}_2$ and $\mathbf{15}_3$ and $\mathbf{15}_4$, with 35 Ω and 15 Ω respectively. Accordingly, in undisturbed operation with symmetrical control at the input and output end of the first or second coaxial line 4 or 6 respectively, a voltage drop of $0.7\cdot U_{E1}$ and $0.7\cdot U_{E2}$ occurs respectively between the inner and the outer conductor of the first and second coaxial line 4 or 6 respectively, and at the input and output end of the first and second stripline 9 or 11 respectively, a voltage drop of $0.3\cdot U_{E1}$ and $0.3\cdot U_{E2}$ respectively occurs between the actual first and second stripline 9 or 11 and the associated earth line 10 or 12 respectively.

Because of the series circuit of the first coaxial line 4 and the first stripline 9 and the second coaxial line 6 and the second stripline 11, with the preferred values for the surge impedances of the first and second coaxial line and stripline in the exemplary embodiment, the input impedance of the high-frequency signal combiner at the two input ports 1 and 2 is 50 Ω respectively. The output impedance of the high-frequency signal combiner at the output port 8 in the exemplary embodiment is 25 Ω because of the parallel circuit of the first series circuit of high-frequency lines comprising the first coaxial line 4 and the first stripline 9 and the second series circuit of high-frequency lines comprising the second coaxial line 6 and the second stripline 11, which corresponds to the bridging circuit illustrated in FIGS. 1A and 1B respectively and comprising the resistors $\mathbf{15}_1$ and $\mathbf{15}_2$, and $\mathbf{15}_3$ and $\mathbf{15}_4$ illustrated by dotted lines.

The signal level $U_A$ of the third high-frequency signal at the output port 8 of the high-frequency signal combiner is obtained according to equation (1) from the sum of the output end of voltage drop between the inner conductor and the outer conductor of the first coaxial line 4 (corresponds to the voltage drop at the virtual resistor $\mathbf{15}_1$) and the output end voltage drop between the second stripline 11 and the associated earth line 12 (corresponds to the voltage drop at the virtual resistor $\mathbf{15}_2$) or, in an equivalent manner, from the sum of the output end voltage drop between the inner conductor and the outer conductor of the second coaxial line 6 (corresponds to the voltage drop at the virtual resistor $\mathbf{15}_3$) and the output end voltage drop between the first stripline 9 and the associated earth line 10 (corresponds to the voltage drop at the virtual resistor $\mathbf{15}_4$), which corresponds in both cases to a first and second high-frequency signal with identical amplitude and phase to the signal level $U_{E1}$ or $U_{E2}$ of the first or second high-frequency signal at the first and second input port 1 and 2.

$$U_A=0.7\cdot U_{E1}+0.3\cdot U_{E2}=\mathbf{0.7}\cdot U_{E2}+0.3\cdot U_{E1}=U_{E1}=U_{E2} \tag{1}$$

The current $I_A$ at the output port 8 of the high-frequency signal combiner is obtained according to equation (2) as the addition of the current $I_1$ through the inner conductor of the first coaxial line 4 and the current $I_2$ through the inner conductor of the second coaxial line 6:

$$I_A=I_1+I_2 \tag{2}$$

The current flow of the current $I_1$ flowing on the inside of the outer conductor of the first coaxial line 4 from the output to the input of the first coaxial line 4, which is complementary to the current $I_1$ flowing on the inner conductor of the first coaxial line 4, is closed via the first stripline 9. In an equivalent manner, the current flow of the current $I_2$ flowing on the inside of the outer conductor of the second coaxial line 6 from the output to the input of the second coaxial line 6, which is complementary to the current $I_2$ flowing on the inner conductor of the second coaxial line 6, is closed via the second stripline 11.

The power $P_A$ at the output port 8 is obtained starting from equation (1) and (2) according to equation (3) from the addition of the powers $P_{E1}$ and $P_{E2}$ at the first and second input port 1 and 2.

$$P_A=I_A\cdot U_{E1}=I_A\cdot U_{E2}=I_1\cdot U_{E1}+I_2\cdot U_{E2}=P_{E1}+P_{E2} \tag{3}$$

In disturbed operation with asymmetric control of the high-frequency signal combiner, one of the two input ports 1 and 2 is not controlled. If, for example, as illustrated in FIG. 1B, the second input port 2 is not controlled, a voltage $U_{E2}$=0V is present at the second input port 2. Accordingly, the voltage drop between the inner conductor and outer conductor of the second coaxial line 6 at the input end and output end of the second coaxial line 6 is 0 V respectively. As a result, the voltage drop from the second stripline 11 to the associated earth line 12 at the input end and output end is also 0 V. In the absence of control of the second input port 2, no current $I_2$ flows through the inner conductor of the second coaxial line 6 or the second stripline 11.

In the absence of control of the second input port 2, the output end potential of the inner conductor of the first coaxial line 4 relative to earth is obtained as $0.7 \cdot U_{E1}$ and corresponds to the voltage drop at the virtual resistor $\mathbf{15}_1$ and $\mathbf{15}_2$. The output end potential of the inner conductor of the second coaxial line 6 relative to earth is obtained as $0.3 \cdot U_{E1}$ and corresponds to the voltage drop at the virtual resistor $\mathbf{15}_3$ and $\mathbf{15}_4$. Because of the different output end potentials at the internal conductors of the first and second coaxial line 4 and 6, a potential balancing occurs between the output end potential of the inner conductor of the first coaxial line 4 relative to earth and the output end potential of the inner conductor of the second coaxial line 6 to earth via the load balancing resistor 13, which, according to equation (4), leads to a voltage $U_A$ of the third high-frequency signal at the output port 8 at the symmetrical mean between $0.3 \cdot U_{E1}$ and $0.7 \cdot U_{E1}$ namely at $0.5 \cdot U_{E1}$.

$$U_A = 0.5 \cdot U_{E1} \tag{4}$$

The output current $I_A$ at the output port 8 of the high-frequency signal combiner corresponds according to equation (5) with the only current $I_1$ flowing through the inner conductor of the first coaxial line 4:

$$I_A = I_1 \tag{5}$$

The power $P_A$ at the output port 8 in disturbed operation is obtained, starting from equation (4) and (5), according to equation (6), which corresponds to one quarter of the power $P_A$ at the output port 8 according to equation (3) in undisturbed operation:

$$P_A = 0.5 \cdot U_{E1} \cdot I_1 \tag{6}$$

Because of the potential balancing between the output end potential of the inner conductor of the first and second coaxial line 4 and 6, the output end potential of the inner conductor of the second coaxial line 6 relative to earth is obtained as $0.5 \cdot U_{E1}$. Because of the output end voltage drop between the inner conductor and the outer conductor of the second coaxial line 6 at the level of 0 V, this also leads to an output end potential of the outer conductor of the second coaxial line 6 relative to earth at the level of $0.5 \cdot U_{E1}$. Since the input end potential of the outer conductor of the second coaxial line 6 is disposed at earth potential because of the non-controlled second input port 2, a voltage drop occurs at the outer conductor of the second coaxial line 6 between the output end and the input end of the second coaxial line 6 at the level of $0.5 \cdot U_{E1}$, which drives a current $I_{Sheath2}$ on the outside of the shielding of the second coaxial line 6 as a so-called sheath wave from the output end to the input end of the second coaxial line 6.

Because of the control of the first input port 1 with the first high-frequency signal of which the signal level provides the value $U_{E1}$, and because of the voltage drop between the inner conductor and outer conductor of the first coaxial line 4 at the level of $0.7 \cdot U_{E1}$, the input end potential of the outer conductor of the first coaxial line 4 provides a value at the level of $0.3 \cdot U_{E1}$. Since the output end potential of the inner conductor of the first coaxial line 4 provides a value at the level of $0.5 \cdot U_{E1}$ because of the potential balancing between the output end potential of the inner conductor of the first and second coaxial line 4 and 6, and the voltage drop between the inner conductor and outer conductor of the first coaxial line 4 is $0.7 \cdot U_{E1}$, the output end potential of the outer conductor of the first coaxial line 4 provides a value at the level of $-0.2 \cdot U_{E1}$. Accordingly, a voltage drop at the outer conductor between the input end and the output end of the first coaxial line 4 at the level of $0.5 \cdot U_{E1}$ is present, which drives a current $I_{Sheath1}$ on the outside of the shielding of the first coaxial line 4 as a so-called sheath wave from the input end to the output end of the first coaxial line 4.

Since the two sheath waves $I_{Sheath1}$ and $I_{Sheath2}$ on the outside of the shielding of the first and second coaxial line 1 and 2 are undesirable, they must be compensated or at least attenuated. Since they are high-frequency signals, they are already attenuated to a certain degree by the inductance per unit length of the first and second coaxial line 4 and 6. The inductance of the first and second coaxial line and accordingly their attenuation characteristic is increased by enclosing the first and second coaxial line 4 and 6 within an annular core made of a magnetizable material. An additional increase in the inductance of the first and second coaxial line 4 and 6 can be achieved through an advantageous arrangement of the first and second coaxial line 4 and 6, as shown in the following section with reference to FIGS. 4A and 4B.

Since the sheath waves $I_{Sheath1}$ and $I_{Sheath2}$ on the first and second coaxial line 1 and 2 are of identical magnitude because of the identical voltage drop in each case between the two ends of the first and second coaxial line 1 and 2, they could form a closed current circuit from the first input port 1 to the second input port 2 via the output port 8 because of their current direction. The inductances of the first and second coaxial line 4 and 6 would then form a series circuit between first and second input port 1 and 2.

Figure 4A:
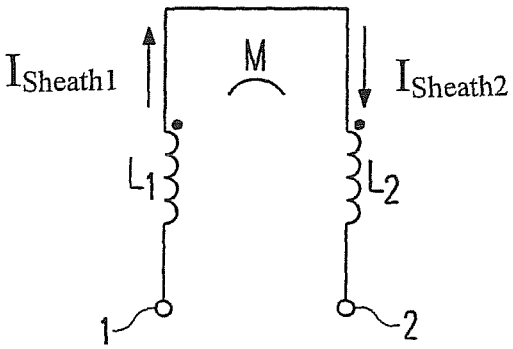
FIG. 4A shows an electrical equivalent circuit diagram for the total inductance of a coupler arrangement with identical orientation of the coaxial lines in the annular core.

If the first and second coaxial line 4 and 6 were in the identical orientation through the recess or borehole 20 of the annular core 7—that is, the input end of the first and second coaxial line 4 and 6 on the one side of the borehole 20 and the output end of the first and second coaxial line 4 and 6 on the other side of the borehole 20—, the equivalent circuit of the series-connected inductance $L_1$ of the first coaxial line 4 and $L_2$ of the second coaxial line 6 is obtained as illustrated in FIG. 4A, wherein the point marks the identical orientation of the inductance $L_1$ and $L_2$. For the total inductance L of the equivalent circuit, the relationship in equation (7) with the counter inductance M according to equation (8) applies. With an identical orientation of the inductance $L_1$ and $L_2$ and different current direction in the two inductances $L_1$ and $L_2$, the counter inductance M induced in the respectively other inductance provides an opposite prefix to the self-inductance generated respectively in the inductances $L_1$ and $L_2$, which is modelled by the minus sign in front of the term 2M.

$$L = L_1 + L_2 - 2M \approx 0 \tag{7}$$

$$M = k\sqrt{L_1 \cdot L_2} \approx L_1 = L_2 = L' \tag{8}$$

With a thin winding of the annular core, the factor k in the mathematical relationship for the counter inductance M is approximately 1, so that approximately the value of the identical self-inductance $L_1 = L_2 = L'$ of the first and second coaxial line 4 and 6 respectively is obtained for the counter inductance M, and a value of approximately zero is obtained for the total inductance L of the equivalent circuit.

Figure 1B:
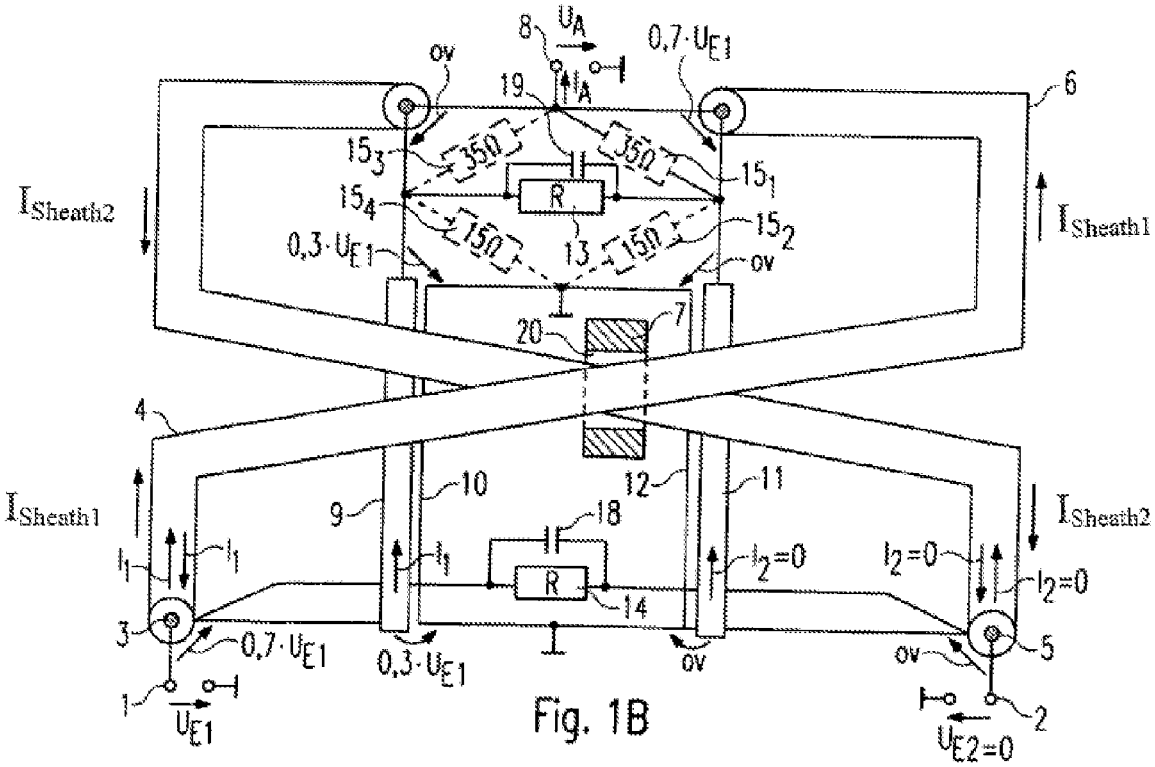
FIG. 1B shows a circuit diagram for a high-frequency signal combiner according to the invention with asymmetric control.
Figure 2:
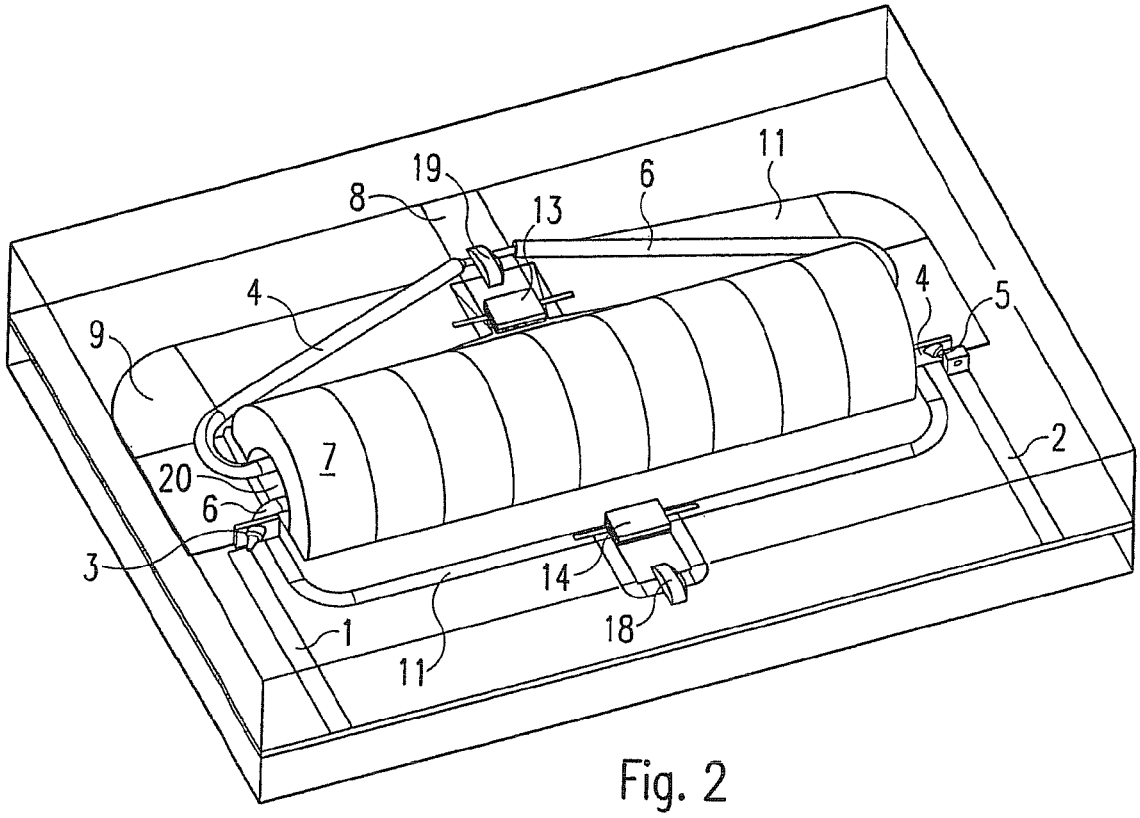
FIG. 2 shows a three-dimensional view of the high-frequency signal combiner according to the invention.
Figure 4B:
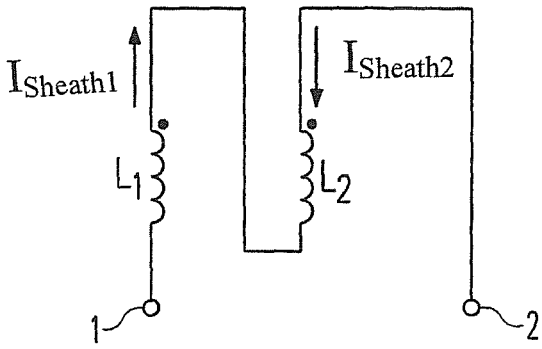
FIG. 4B shows an electrical equivalent circuit diagram for the total inductance of a coupler arrangement with different orientation of the coaxial lines in the annular core.

If the first and second coaxial line 4 and 6 provide a different orientation in the borehole 20 of the annular core 7, as indicated in FIG. 1A and 1B, the equivalent circuit diagram illustrated in FIG. 4B is obtained for the total inductance L of the equivalent circuit. With an identical orientation of the inductance $L_1$ and $L_2$ and an identical current direction in both inductances $L_1$ and $L_2$, the counter inductance M induced in the respectively other inductance provides the same prefix as the self-inductance generated respectively in the inductance $L_1$ and $L_2$, which is modelled according to equation (9) by a plus sign in front of the term 2M in the mathematical relationship for the total inductance L.

$$L=L_1+L_2-2M\approx 4L \quad (7)$$

The total inductance L for an arrangement of a first and second coaxial line 4 and 6, in which the orientation of the first and second coaxial line 4 and 6 within the borehole 20 of the annular core 7 is different in each case, is accordingly quadrupled by comparison with the self-inductance $L_1$ and $L_2$ of the first or second coaxial line 4 or 6.

Figure 3:
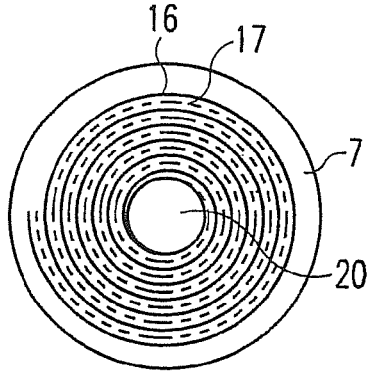
FIG. 3 shows a section through a magnetic core used in the high-frequency signal combiner according to the invention.

A further increase of the inductance in the first and second coaxial line 4 and 6 and accordingly of the total inductance L for the coupler arrangement of a first and second coaxial line 4 and 6 is achieved by the use according to the invention of an annular core 7, which is manufactured according to FIG. 3 from an axially wound strip, which comprises a first layer 16 made of magnetizable iron and a second layer 17 made of an insulating layer, for example, an oxide or a nitride, preferably an insulating magnesium oxide.

The spiral arrangement of the strip comprising magnetizable iron and insulating magnesium oxide in the annular core significantly reduces the eddy current threshold frequency $f_g$ by comparison with a conventional ferrite core manufactured using sintering technology. Together with the increased material density of the magnetizable iron in the annular core by comparison with a conventional ferrite core, a saturation inductance $B_s$ three times higher and a significantly higher permeability coefficient $\mu_r$ are achieved ($\mu_r\approx 100000$ by comparison with $\mu_r\approx 5000$ in ferrite cores manufactured using conventional sintering technology). Increased saturation inductance $B_s$ and an increased permeability coefficient $\mu_r$ allow a higher self-inductance $L_1$ and $L_2$ and a higher counter inductance M of the first and second coaxial line 4 and 6 and accordingly a higher total inductance L of the coupler arrangement. Additionally, the higher material density in the annular core allows an improved compactness of the high-frequency signal combiner.

In order additionally to improve the compactness of the high-frequency signal combiner, the coaxial lines of the original high-frequency signal combiner, which lead back the current flowing on the inside of the shielding of the first and second coaxial line 4 and 6, are each replaced according to the invention by a space-saving first and second stripline 9 and 11.

In order to achieve improved electrical properties of the high-frequency signal combiner according to the invention, the first and second stripline 9 and 11 provide a reduced surge impedance by comparison with the first and second coaxial line 4 and 6, namely a surge impedance at the level of 15 Ω by comparison with a surge impedance at the level of 35 Ω in the case of the first and second coaxial line 4 and 6. The physical length of the first and second stripline 9 and 11 at the level of 70 mm to 120 mm, preferably 92.3 mm, is accordingly shorter than the physical length of the first and second coaxial line 4 and 6 at the level of 150 mm to 200 mm, preferably 187 mm.

The invention is not restricted to the embodiment presented. In particular, other parameter combinations for the surge impedances of the coaxial lines and striplines, which lead to a given input impedance, especially of 50 Ω, and a given output impedance, especially of 25 Ω, of the high-frequency signal combiner are covered by the invention.

The invention claimed is:

1. A high-frequency signal combiner with a first input terminal for the connection of a first high-frequency signal, a second input terminal for the connection of a second high-frequency signal, an output terminal for the output of a third high-frequency signal combined from the first and the second high-frequency signal, a first coaxial line between the first input terminal and the output terminal, a second coaxial line between the second input terminal and the output terminal and an annular core, through a recess of which the first and second coaxial line are guided, wherein a first microstripline is additionally formed between the input terminal and the output terminal, and a second microstripline is formed between the second input terminal and the output terminal, wherein a surge impedance of the first and second coaxial line is different from a surge impedance of the first and second microstripline, and wherein a physical length of the first and second coaxial line is different from a physical length of the first and second microstripline.

2. The high-frequency signal combiner according to claim 1, wherein the first and second coaxial line each provide a surge impedance of approximately 35 Ω, and the first and second microstripline each provide a surge impedance of approximately 15 Ω.

3. The high-frequency signal combiner according to claim 1, wherein the first and second coaxial line each provide a physical length from 150 mm to 200 mm, and the first and second microstripline each provide a physical length from 70 mm to 120 mm.

4. The high-frequency signal combiner according to claim 1, wherein the first and second coaxial line each provide a physical length of 187 mm, and the first and second microstripline each provide a physical length of 92.3 mm.

5. The high-frequency signal combiner according to claim 1, wherein the annular core is manufactured from a strip, which comprises a first layer made of a magnetizable material and a second layer made of an insulating material.

6. The high-frequency signal combiner according to claim 5, wherein the first layer is a 5 to 50 μm thick iron layer, and the second layer is 0.1 to 1 μm thick oxide or nitride layer.

7. The high-frequency signal combiner according to claim 6, wherein the second layer includes magnesium oxide.

8. The high-freqency signal combiner according to claim 5, wherein the first layer is a 16 to 20 μm thick iron layer, and the second layer is a 0.5 μm thick oxide or nitride layer.

* * * * *